US006026330A

United States Patent [19]

Chuang

[11] Patent Number: 6,026,330

[45] Date of Patent: Feb. 15, 2000

[54] MULTI-FUNCTION PILLOW

[76] Inventor: Henry Chuang, 422 E. Valley Blvd., San Gabriel, Calif. 91775

[21] Appl. No.: 08/957,670

[22] Filed: Oct. 24, 1997

[51] Int. Cl.[7] ..... A47G 9/00

[52] U.S. Cl. ..... 607/100; 5/421; 5/636; 5/948; 5/951; 5/645

[58] Field of Search ..... 5/636, 695, 948, 5/951, 421, 448; 607/100, 96, 112, 114, 108–110; 600/1–2; 128/112.1–125.1

[56] References Cited

U.S. PATENT DOCUMENTS

| | | | |
|---|---|---|---|
| 4,222,468 | 9/1980 | De Fries | 190/42 |
| 4,680,822 | 7/1987 | Fujino et al. | 5/421 |
| 4,886,972 | 12/1989 | Nakai et al. | 250/504 R |
| 4,980,940 | 1/1991 | Isshiki | 4/468 |
| 5,103,517 | 4/1992 | Krouskop | 5/450 |
| 5,193,236 | 3/1993 | Komuro | 5/636 |
| 5,840,080 | 11/1998 | Der Ovanesian | 607/114 |

FOREIGN PATENT DOCUMENTS

| | | | |
|---|---|---|---|
| 404276217 | 10/1992 | Japan | A47C 27/22 |

*Primary Examiner*—Linda C. M. Dvorak
*Assistant Examiner*—Roy Gibson
*Attorney, Agent, or Firm*—Raymond Chan; David and Raymond

[57] ABSTRACT

A multi-function pillow includes a bag body having a ventilative first layer and a ventilative second layer connected peripherally to define an receiving chamber therein, an intermediate layer mounted between the first and second layers to divide the receiving chamber into a first chamber and a second chamber, a plurality of wheat hulls filled inside the first chamber, a plurality of far-infrared emission granules evenly distributed inside the first chamber and mixed with the wheat hulls, and a supporting filler disposed inside the second chamber. The multi-function pillow can provide better support to the user's head and neck at a comfortable position that, regardless the weight and the movement of the user's head, the bottom portion of the user's head will still be well supported by the pillow and may avoid direct contact with the mattress or bed surface. The supporting filler includes a far-infrared polyester made of polyester containing far-infrared emission substances, so that even if the user is sleeping or sitting on the second layer, the user may still absorb far-infrared radiation emitted from the supporting filler. Two sides of the intermediate layer are coated with far-infrared ray reflective layers respectively for reflecting those far-infrared radiation emitted inwardly from the far-infrared emission granules outwards to transmit towards the first and second layers of the bag body, so as to gather the far-infrared ray to enhance the absorption of the far-infrared radiation of the user.

43 Claims, 3 Drawing Sheets

MULTI-FUNCTION PILLOW

FIELD OF THE PRESENT INVENTION

The present invention relates to an improvement of pillow, and more particularly to a multi-function pillow that not only can provide good and comfortable support to the user's head and neck but also can enhance the blood circulation and metabolism of the user by means of a plurality of far-infrared granules which are the far-infrared ray emission substances distributed inside the pillow.

BACKGROUND OF THE PRESENT INVENTION

In average, most people spend eight hours a day on bed. In other words, everybody's head has to rest on a pillow for one third of a day. A comfortable pillow that has good ventilation feature becomes the most important factor of having a good sleep. The common pillow is made of polyester that fails to well support the neck portion of the user and to provide sufficient ventilation to the user's head.

In recent years, buckwheat hulls are used as the filler of pillow or cushion. Since the buckwheat hulls have excellent resilience strength that can prevent fragmentation under pressure, the buckwheat hulls are good filler for pillows that can provide remarkable ventilation, that the cool and refreshing buckwheat pillow enables the user's head to comfortably rest thereon. Furthermore, the user may shape the pillow to fit his or her head shape in order to achieve a better support to his or her head and neck. However, such buckwheat pillows are not so popular in market and being accepted by the consumers. It is because the granulated buckwheat hulls are movable due to compression or pressure. Therefore, as shown in FIG. 1, most users find that the buckwheat hulls filled inside the fiber pillow bag will be easily shifted aside due to the numerous turning movement and the weight of the user's head, so that finally the bottom portion of the user's head will directly contact with and press on the mattress surface that causes very uncomfortable feeling. In addition, the ventilative feature of the buckwheat pillow may also provide reverse effect in winter season, that the user may feel too cool to sleep thereon.

Furthermore, it is well known that infrared is a kind of electromagnetic wave having great benefit to human health. All nature electromagnetic waves are classified according to their wave length and frequency. Sunlight generally comprises 7% of destroying ray including α-ray, X-ray and ultraviolet ray, 13% of visible light, and 80% of infrared ray and micro-ray. The infrared ray can also be further classified as the intimate infrared ray having a wave length of 0.76 to 1.5 μm, the middle infrared ray having a wave length of 1.5 to 5 μm, the far-infrared ray having a wave length of 5 to 100 μm, and the super far infrared ray having a wave length of 100 to 1000 μm.

We know that 60 to 70% of human body is constituted by water molecules and 30 to 40% of organic molecules such as protein. Both the water molecules and the organic molecules selectively reflect, absorb and transmit the infrared radiation that has a wave length of 5–25 μm, wherein 60% of the entire radiation energy discharged by human body has a wave length of 8 to 15 μm. Since the human body can emit far-infrared ray of the above wave length, the human body is thus capable of absorbing far-infrared ray of such wave length. In other words, the best wave length of the far-infrared radiation for human absorption is 8 to 15 μm. When human body absorbs the far-infrared ray having the wave length of 8 to 15 μm, the absorbed far-infrared ray will cause the water molecules inside the human body generating resonance that may activate the water molecules to enhance the bonding ability among the water molecules so as to further activate the big organic molecules, so that the animal cells will perform high vibrating energy level. Since the animal cells will generate resonance effect, the far-infrared heat energy would be transmitted to a deeper portion under the human skin, so as to increase the heat temperature of such deep layer under the human skin. In which the heat generated will emit outwardly that would cause the blood vessels of human being to expand, so as to advance the blood circulation, to strengthen the metabolism among the body tissues, to remove the obstacle of body fluid, to enhance the regeneration ability, to enhance the human immunity, and to regulate the unusual exciting condition of human nerves system.

Some natural substances such as far-infrared ceramics can discharge far-infrared radiation. If such far-infrared emission substances can be used as the constructing material of the pillow, the user can thus absorb the far-infrared radiation to advance his or her health during sleeping.

SUMMARY OF THE PRESENT INVENTION

It is thus a main object of the present invention to provide a multi-function pillow or cushion which can provide better support to the user's head and neck at a comfortable position that, regardless the weight and the movement of the user' head, the bottom portion of the user's head will still be well supported by the pillow and may avoid from directly contact with the mattress or bed surface.

A further object of the present invention is to provide a multi-function pillow or cushion which contains far-infrared emission substances therein to continuously discharge far-infrared radiation so as to advance the user's health while the user's body is in contact with the pillow.

Yet another object of the present invention is to provide a multi-function pillow or cushion which comprises a reflecting layer disposed therein that can perform a mirror effect to reflect the far-infrared ray emitted from the far-infrared emission substances therein outwards so as to enhance the absorption of the far-infrared radiation by the user.

In order to accomplish the above objects, the present invention provides a multi-function pillow comprising a bag body having a ventilative first layer and a ventilative second layer connected peripherally to define an receiving chamber therein, an intermediate layer mounted between the first and second layers to divide the receiving chamber into a first chamber and a second chamber, a plurality of wheat hulls filled inside the first chamber, a plurality of far-infrared emission granules evenly distributed inside the first chamber and mixed with the wheat hulls, and a supporting filler disposed inside the second chamber.

The intermediate layer has a first side opposing the first chamber coated with a first far-infrared ray reflective layer for reflecting those far-infrared radiation emitted inwardly from the far-infrared emission granules outwards to transmit towards the fist layer of the bag body, so as to gather the far-infrared ray to enhance the absorption of the far-infrared radiation of the user.

The supporting filler can be a piece of foam material or comprises a fiber filler made of far-infrared polyester which is a kind of polyester containing far-infrared emission substances, so that even the user is sleep or sit on the second layer, the user may still absorb far-infrared radiation emitted from the supporting filler. Moreover, the intermediate layer has a second side opposing the second chamber coated with a second far-infrared ray reflective layer for reflecting those far-infrared radiation emitted inwardly from the far-infrared polyester outwards to transmit towards the second layer of the bag body.

DETAILED DESCRIPTION OF THE PREFERRED EMBODIMENT

Figure 1:
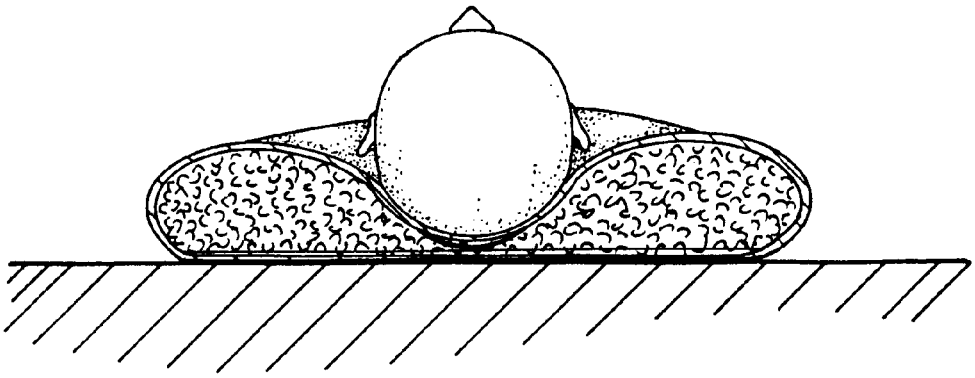
FIG. 1 PRIOR ART
FIG. 1 is a sectional view of a conventional buckwheat pillow.
Figure 2:
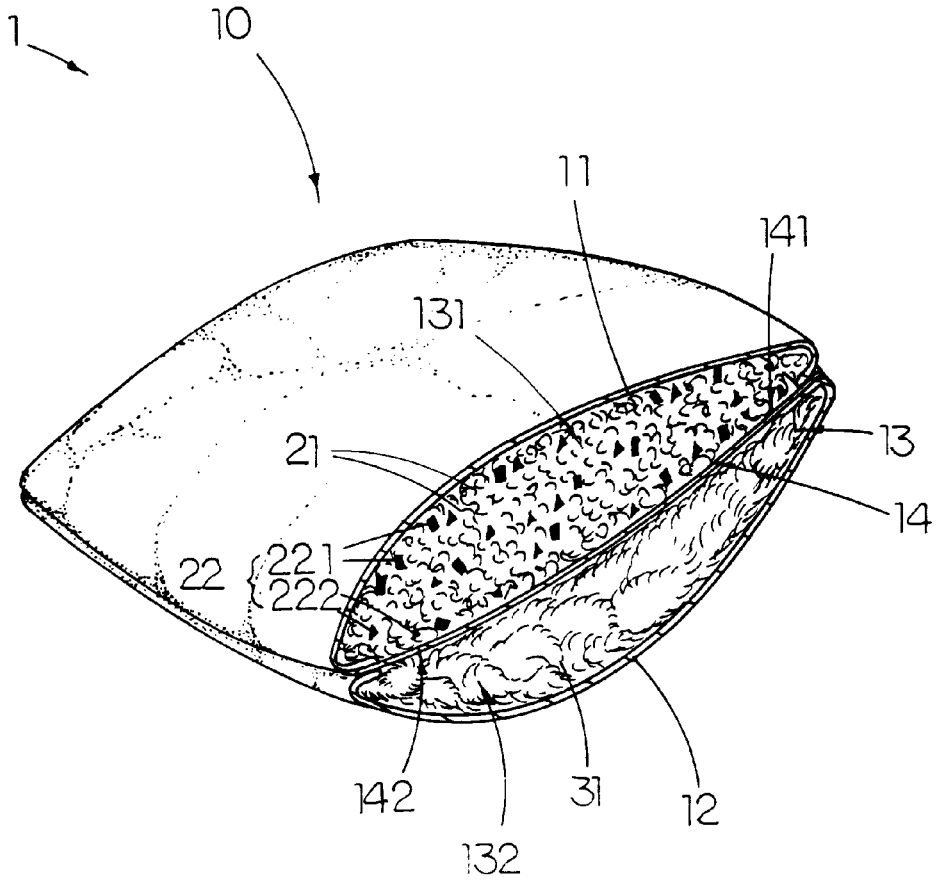
FIG. 2 is a partial sectional perspective view of a multi-function pillow in accordance with a preferred embodiment of the present invention.

Referring to FIG. 2, a multi-function pillow 1 according to a preferred embodiment of the present invention is illustrated. The multi-function pillow 1 comprises a bag body 10 having a ventilative first layer 11 and a ventilative second layer 12 connected peripherally with the first layer 11 to define an receiving chamber 13 therebetween, an intermediate layer 14 mounted between the first and second layers 11, 12 to divide the receiving chamber 13 into a first chamber 131 and a second chamber 132, a plurality of wheat hulls 21 filled inside the first chamber 131, a plurality of far-infrared emission granules 22 evenly distributed inside the first chamber 131 and mixed with the wheat hulls 21, and a supporting filler 31 disposed inside the second chamber 132.

The first and second layers 11, 12 of the bag body 10 are made of ventilative cloth or fiber and are sewed along their periphery to form a bag. An opening may be left open before filling in the supporting filler 31 and the wheat hulls 21. After putting the supporting filler 31 into the second chamber 132 and the wheat hulls 21 and the far-infrared emission granules 22 into the first chamber 131, the opening can be sewed to close or closed by means of zipper.

An adequate amount of the wheat hulls 21 are filled inside the first chamber 131 to allow shifting movement of the wheat hulls 21 to permit the user to shape the pillow 1 to desired shape fit his or her head shape. Preferably, buckwheat hulls are used as the wheat hulls 21.

The far-infrared emission granules 22 comprises a plurality of mixed far-infrared ceramic granules 221 each of which is made of far-infrared ceramic powder mixed with a polypropylene to form a granule body. Each of the mixed far-infrared ceramic granules 221 is preferably composed of 24% by weight of far-infrared ceramic powder and 76% by weight of polypropylene. The far-infrared ceramic powder is made by mixing a plurality of far-infrared ray emission substances including $SiO_2$, SiC, $TiO_2$, NiO, $Al_2O_2$, BeO, $FeO_3$, $Cr_2O_2$, ZrC, TaC, and $Ce_2O_2$.

As mentioned above, human body emits far-infrared ray having a wave length of 5 to 25 $\mu$m, wherein 60% of the human emitting far-infrared ray having a wave length of 8 to 15 $\mu$m. Since human body emits such 8 to 15 $\mu$m far-infrared ray, in other words, human body would absorb such 8 to 15 $\mu$m far-infrared ray. The far-infrared ceramic powder is a very good far-infrared ray emission substance. It can continuously emit far-infrared ray of 5 to 25 $\mu$m, mainly of 8 to 15 $\mu$m, which is substantially equal to the far-infrared ray emitted from human body. Thus, the far-infrared ceramic powder is an ideal far-infrared ray emission substance for human body and enables the human body to absorb such far-infrared ray efficiently and cause a series of physical, chemical and biological healthy effects for the human body.

Of course, the far-infrared emission granule 22 can also be made of pure far-infrared ceramic powder which are adhered by adhesive material to form a pure far-infrared emission granule 222, wherein 90% by weight of far-infrared ceramic powder is mixed with 10% by weight of the adhesive material. The far-infrared emission granules 22 filled inside the first chamber 131 can be composed of both the mixed far-infrared emission granules 221 and the pure far-infrared emission granules 222. According to the present preferred embodiment, 70% by weight of the buckwheat hulls 21 are preferably evenly mixed with 15% by weight of the mixed far-infrared emission granules 221 and 15% by weight of the pure far-infrared emission granules 222.

Since the far-infrared radiation emitted from the far-infrared emission granules 22 is discharged in all directions, portion of the far-infrared radiation would be emitted towards the intermediate layer 14. In order to effectively utilize the maximum percentage of the emitted far-infrared ray, a first side of the intermediate layer 14 opposing the first chamber 131 is coated with a first far-infrared ray reflective layer 141 of aluminum foil to provide a mirror effect to the far-infrared ray, so that those far-infrared ray emitted inwardly from the far-infrared emission granules 22 will be reflected outwards to transmit towards the fist layer 11 of the bag body 10, so as to gather the far-infrared ray to enhance the absorption of the far-infrared radiation of the user.

Figure 3:
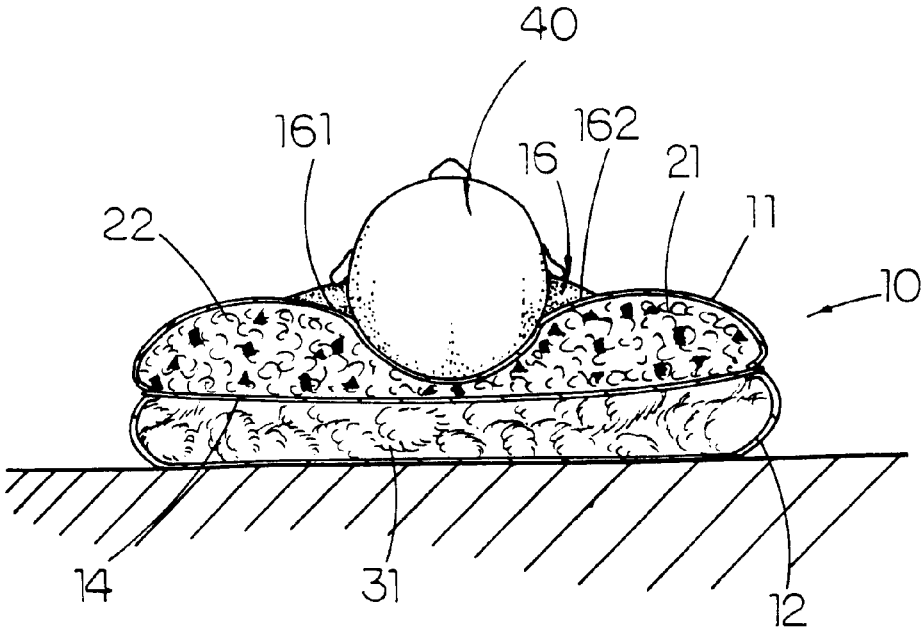
FIG. 3 is a sectional front view of the multi-function pillow with an user's head resting thereon according to the above preferred embodiment of the present invention.
Figure 4:
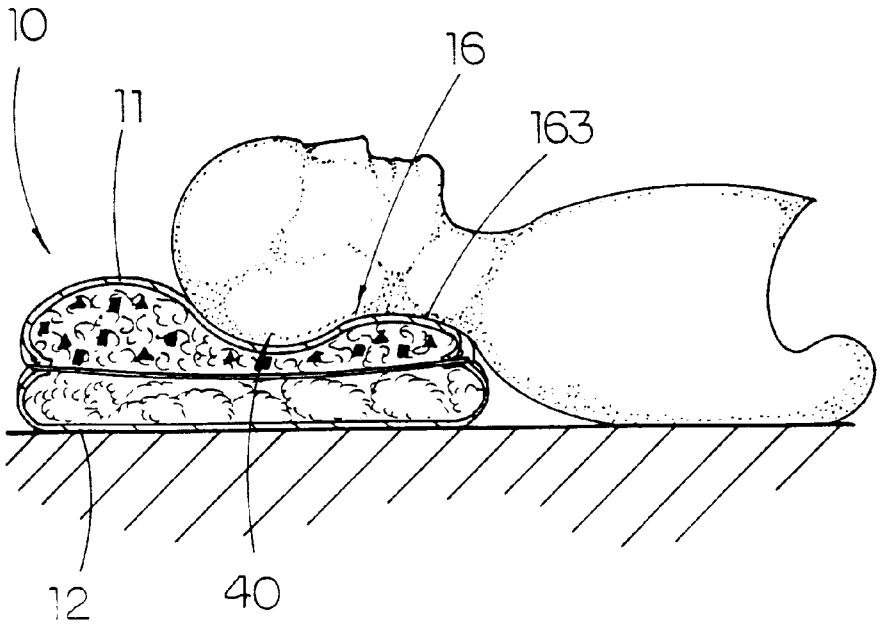
FIG. 4 is a sectional end view of the multi-function pillow with an user's head resting thereon according to the above preferred embodiment of the present invention.

The second chamber 132 is filled with the supporting filler 31 which can be a piece of foam material such as EVA or foam rubber or comprises a fiber filler made of silk, cotton or far-infrared polyester which is a kind of polyester containing far-infrared emission substances. The supporting filler 31 virtually acts as a supporter when the second layer 12 is positioned downwards, as shown in FIGS. 3 and 4, and a user 40 is sleeping on the first layer 11. The user 40 may shaped the pillow 1 to form a sunken portion 16 to fit his or her head shape. Such sunken portion 16 may also formed automatically due to the weight of the head of the user 40. The two lateral sides 161, 162 of the sunken portion 16 will support the two sides of the head of the user 40, as shown in FIG. 3. A lower side 163 of the sunken portion 16 would fittedly support to the neck portion of the user 40, as shown in FIG. 4. The most distinguishable characteristic of the present invention is that, regardless of the weight and the movement of the head of the user 40, the bottom portion of the head of the user 40 is well supported by the soft and comfortable supporting filler 31 within the second chamber 132 under the first chamber 131. In fact, even all the buckwheat hulls 21 and the far-infrared emission granules 22 are shifted aside, the head of the user 40 will not directly in contact with the bed or mattress's surface.

During the cold winter season, some users may prefer to sleep on the polyester pillow because of its warm and soft feeling and to enable the user to still absorb the far-infrared radiation for health purposes. As mentioned above, according to the present embodiment, the supporting filler 31 is made to comprise the far-infrared polyester made of polyester containing far-infrared emission substances, so that even the user is sleep on the second layer 12, the user may still absorb the far-infrared radiation emitted from the far-infrared polyester 31. Moreover, a second side of the intermediate layer 14, which is opposing the second chamber 132, is coated with a second far-infrared ray reflective layer 142 of aluminum foil to provide a mirror effect to the far-infrared ray, so that those far-infrared ray emitted inwardly from the far-infrared polyester 31 will be reflected outwards to transmit towards the second layer 132 of the bag body 10.

Accordingly, the present invention as illustrated above can accomplish the following advantages: The multi-function pillow can provide better support to the user's head and neck at a comfortable position that, regardless the weight and the movement of the user's head, the bottom portion of the user' head will still be well supported by the pillow and may avoid from directly contact with the mattress or bed surface. The multi-function pillow contains far-infrared emission substances therein to continuously discharge far-infrared radiation so as to advance the user's health while the user's body is in contact with the pillow. The multi-function pillow comprises a reflecting layer disposed therein that can perform a mirror effect to reflect the far-infrared ray emitted from the far-infrared emission substances therein outwards so as to enhance the absorption of the far-infrared radiation by the user.

It is worth to mentioned that the multi-function pillow of the present invention is able to work as a cushion or chair pad by simply amending the size for supporting a user's back or hip, that very good ventilative feature and supporting function can both be obtained.

What is claimed is:

1. A multi-function pillow, comprising a bag body having a ventilative first layer and a ventilative second layer connected peripherally with said first layer to define a receiving chamber therebetween;

an intermediate layer mounted between said first and second layers to divide said receiving chamber into a first chamber and a second chamber;

a plurality of wheat hulls filling the inside of said first chamber;

a plurality of far-infrared emission granules, which continuously emit a far-infrared radiation, being evenly distributed inside said first chamber and mixed with said wheat hulls; and a supporting filler disposed inside said second chamber.

2. A multi-function pillow, as recited in claim 1, wherein said intermediate layer has a first side opposing said first chamber coated with a first far-infrared ray reflective layer for reflecting said far-infrared radiation emitted inwardly from said far-infrared emission granules outwards to transmit towards said first layer of said bag body, so as to gather said far-infrared radiation to enhance an absorption of said far-infrared radiation of a user.

3. A multi-function pillow, as recited in claim 2, wherein said first side of said intermediate layer is coated with aluminum foil to form said first far-infrared ray reflective layer for providing a mirror effect to said far-infrared ray.

4. A multi-function pillow, as recited in claim 2, wherein said supporting filler comprises a far-infrared polyester made of polyester containing far-infrared emission substances.

5. A multi-function pillow, as recited in claim 1, wherein said far-infrared emission granules comprises a plurality of mixed far-infrared ceramic granules which is made of at least a far-infrared ray emission substance, each of said mixed far-infrared ceramic granules being made of far-infrared ceramic powder mixed with a polypropylene to form a granule body.

6. A multi-function pillow, as recited in claim 5, wherein each of said mixed far-infrared ceramic granules composed of 24% by weight of far-infrared ceramic powder and 76% by weight of polypropylene.

7. A multi-function pillow, as recited in claim 6, wherein said far-infrared emission granules further comprises a plurality of pure far-infrared ceramic granules which are made of said far-infrared ceramic powder adhered by an adhesive material.

8. A multi-function pillow, as recited in claim 7, wherein each of said pure far-infrared emission granules is made of 90% by weight of said far-infrared ceramic powder and 10% by weight of said adhesive material.

9. A multi-function pillow, as recited in claim 7, wherein said wheat hulls are buckwheat hulls, and that said second chamber contains 70% by weight of said wheat hulls, 15% by weight of said mixed far-infrared emission granules and 15% by weight of said pure far-infrared emission granules.

10. A multi-function pillow, as recited in claim 8, wherein said wheat hulls are buckwheat hulls, and that said second chamber contains 70% by weight of said wheat hulls, 15% by weight of said mixed far-infrared emission granules and 15% by weight of said pure far-infrared emission granules.

11. A multi-function pillow, as recited in claim 10, wherein said far-infrared ceramic powder is made by mixing a plurality of far-infrared ray emission substances including SiO2, SiC, TiO2, NiO, Al2O2, BeO, FeO3, Cr2O2, ZrC, TaC, and Ce2O2.

12. A multi-function pillow, as recited in claim 10, wherein said supporting filler comprises a far-infrared polyester made of polyester containing far-infrared emission substances.

13. A multi-function pillow, as recited in claim 12, wherein said intermediate layer has a second side opposing said second chamber coated with a second far-infrared ray reflective layer for reflecting said far-infrared radiation emitted inwardly from said far-infrared polyester outwards to transmit towards said second layer of said bag body.

14. A multi-function pillow, as recited in claim 1, wherein each of said far-infrared emission granules is made of a far-infrared ceramic powder which is adhered by an adhesive material to form a pure far-infrared emission granule.

15. A multi-function pillow, as recited in claim 14, wherein each of said pure far-infrared emission granules is made of 90% by weight of said far-infrared ceramic powder and 10% by weight of said adhesive material.

16. A multi-function pillow, as recited in claim 5, wherein said far-infrared emission granules further comprises a plurality of pure far-infrared ceramic granules which are made of said far-infrared ceramic powder adhered by an adhesive material.

17. A multi-function pillow, as recited in claim 16, wherein each of said pure far-infrared emission granules is made of 90% by weight of said far-infrared ceramic powder and 10% by weight of said adhesive material.

18. A multi-function pillow, as recited in claim 17, wherein said wheat hulls are buckwheat hulls, and that said second chamber contains 70% by weight of said wheat hulls, 15% by weight of said mixed far-infrared emission granules and 15% by weight of said pure far-infrared emission granules.

19. A multi-function pillow, as recited in claim 18, wherein said far-infrared ceramic powder is made by mixing a plurality of far-infrared ray emission substances including SiO2, SiC, TiO2, NiO, Al2O2, BeO, FeO3, Cr2O2, ZrC, TaC, and Ce2O2.

20. A multi-function pillow, as recited in claim 16, wherein said wheat hulls are buckwheat hulls, and that said second chamber contains 70% by weight of said wheat hulls, 15% by weight of said mixed far-infrared emission granules and 15% by weight of said pure far-infrared emission granules.

21. A multi-function pillow, as recited in claim 20, wherein said supporting filler comprises a far-infrared polyester made of polyester containing far-infrared emission substances.

22. A multi-function pillow, as recited in claim 21, wherein said intermediate layer has a second side opposing said second chamber coated with a second far-infrared ray reflective layer for reflecting said far-infrared radiation emitted inwardly from said far-infrared polyester outwards to transmit towards said second layer of said bag body.

23. A multi-function pillow, as recited in claim 2, wherein said far-infrared emission granules comprises a plurality of mixed far-infrared ceramic granules which is made of at least a far-infrared ray emission substance, each of said mixed far-infrared ceramic granules being made of far-infrared ceramic powder mixed with a polypropylene to form a granule body.

24. A multi-function pillow, as recited in claim 23, wherein each of said mixed far-infrared ceramic granules composed of 24% by weight of far-infrared ceramic powder and 76% by weight of polypropylene.

25. A multi-function pillow, as recited in claim 24, wherein said far-infrared emission granules further comprises a plurality of pure far-infrared ceramic granules which are made of said far-infrared ceramic powder adhered by an adhesive material.

26. A multi-function pillow, as recited in claim 25, wherein each of said pure far-infrared emission granules is made of 90% by weight of said far-infrared ceramic powder and 10% by weight of said adhesive material.

27. A multi-function pillow, as recited in claim 25, wherein said wheat hulls are buckwheat hulls and that said second chamber contains 70% by weight of said buckwheat hulls, 15% by weight of said mixed far-infrared emission granules and 15% by weight of said pure far-infrared emission granules.

28. A multi-function pillow, as recited in claim 26, wherein said wheat hulls are buckwheat hulls and that said wheat hulls are buckwheat hulls, and that said second chamber contains 70% by weight of said wheat hulls, 15% by weight of said mixed far-infrared emission granules and 15% by weight of said pure far-infrared emission granules.

29. A multi-function pillow, as recited in claim 28, wherein said far-infrared ceramic powder is made by mixing a plurality of far-infrared ray emission substances including SiO2, SiC, TiO2, NiO, Al2O2, BeO, FeO3, Cr2O2, ZrC, TaC, and Ce2O2.

30. A multi-function pillow, as recited in claim 28, wherein said supporting filler comprises a far-infrared polyester made of polyester containing far-infrared emission substances.

31. A multi-function pillow, as recited in claim 30, wherein said intermediate layer has a second side opposing said second chamber coated with a second far-infrared ray reflective layer of aluminum foil for providing a mirror effect for reflecting said far-infrared radiation emitted inwardly from said far-infrared polyester outwards to transmit towards said second layer of said bag body.

32. A multi-function pillow, as recited in claim 23, wherein said far-infrared emission granules further comprises a plurality of pure far-infrared ceramic granules which are made of said far-infrared ceramic powder adhered by an adhesive material.

33. A multi-function pillow, as recited in claim 32, wherein each of said pure far-infrared emission granules is made of 90% by weight of said far-infrared ceramic powder and 10% by weight of said adhesive material.

34. A multi-function pillow, as recited in claim 33, wherein said wheat hulls are buckwheat hulls and that said wheat hulls are buckwheat hulls, and that said second chamber contains 70% by weight of said wheat hulls, 15% by weight of said mixed far-infrared emission granules and 15% by weight of said pure far-infrared emission granules.

35. A multi-function pillow, as recited in claim 34, wherein said far-infrared ceramic powder is made by mining a plurality of far-infrared ray emission substances including SiO2, SiC, TiO2, NiO, Al2O2, BeO, FeO3, Cr2O2, ZrC, TaC, and Ce2O2 .

36. A multi-function pillow, as recited in claim 32, wherein said wheat hulls are buckwheat hulls and that said second chamber contains 70% by weight of said buckwheat hulls, 15% by weight of said mixed far-infrared emission granules and 15% by weight of said pure far-infrared emission granules.

37. A multi-function pillow, as recited in claim 36, wherein said supporting filler comprises a far-infrared polyester made of polyester containing far-infrared emission substances.

38. A multi-function pillow, as recited in claim 37, wherein said intermediate layer has a second side opposing said second chamber coated with a second far-infrared ray reflective layer of aluminum foil for providing a mirror effect for reflecting said far-infrared radiation emitted inwardly from said far-infrared polyester outwards to transmit towards said second layer of said bag body.

39. A multi-function pillow, as recited in claim 2, wherein each of said far-infrared emission granules is made of a far-infrared ceramic powder which is adhered by an adhesive material to form a pure far-infrared emission granule.

40. A multi-function pillow, as recited in claim 39, wherein each of said pure far-infrared emission granules is made of 90% by weight of said far-infrared ceramic powder and 10% by weight of said adhesive material.

41. A multi-function pillow, as recited in claim 1, wherein said supporting filler comprises a fiber filler filled inside said second chamber to support said wheat hulls and said far-infrared emission granules within said first chamber.

42. A multi-function pillow, as recited in claim 41, wherein fiber filler comprises a kind of far-infrared polyester made of polyester containing far-infrared emission substances, and that said intermediate layer has a second side opposing said second chamber coated with a second far-infrared ray reflective layer for reflecting said far-infrared radiation emitted inwardly from said far-infrared polyester outwards to transmit towards said second layer of said bag body.

43. A multi-function pillow, as recited in claim 41, wherein said intermediate layer has a second side opposing said second chamber coated with a second far-infrared ray reflective layer of aluminum foil for providing a mirror effect for reflecting said far-infrared radiation emitted inwardly from said far-infrared polyester outwards to transmit towards said second layer of said bag body.

* * * * *